United States Patent [19]

Giardino

[11] 4,278,103

[45] Jul. 14, 1981

[54] OVERSPEED CONTROL MEANS FOR PNEUMATIC TOOLS

[75] Inventor: David A. Giardino, Deerfield, N.Y.

[73] Assignee: Chicago Pneumatic Tool Company, New York, N.Y.

[21] Appl. No.: 109,775

[22] Filed: Jan. 7, 1980

[51] Int. Cl.[3] ..... F01C 21/12

[52] U.S. Cl. ..... 137/50; 137/57; 418/41; 418/43

[58] Field of Search ..... 137/50, 57; 418/40–44

[56] References Cited

U.S. PATENT DOCUMENTS

| | | | |
|---|---|---|---|
| 3,020,920 | 2/1962 | Kaman | 137/50 |
| 3,257,913 | 6/1966 | Broom | 418/43 |
| 3,552,410 | 1/1971 | Amtsberg | 137/56 |
| 3,749,530 | 1/1972 | Amador | 418/41 |
| 3,923,429 | 12/1975 | Schaedler | 418/43 |
| 3,930,764 | 1/1976 | Curtiss | 137/57 X |
| 4,184,819 | 1/1980 | Clark | 137/57 X |

*Primary Examiner*—Robert G. Nilson
*Attorney, Agent, or Firm*—Stephen J. Rudy

[57] ABSTRACT

An overspeed control means for pneumatic tools which includes a split ring valve slidably arranged in a circumferential groove formed in a cage member affixed to the rotor shaft of the tool. When the cage member exceeds a predetermined rotational speed, the ring valve will expand and be moved, by pressure differential acting thereupon, into engagement with a valve seat to block holes in a flow circuit for pneumatic medium being conducted to the rotor of the tool, whereby tool operation is terminated.

6 Claims, 2 Drawing Figures

OVERSPEED CONTROL MEANS FOR PNEUMATIC TOOLS

BACKGROUND OF THE INVENTION

This invention relates to a control means which prevents overspeed of a motor used on a pneumatic tool.

Hand-held pneumatic tools, which operate at high rotary speed, i.e., up to 12,000 r.p.m., such as on tools used in grinding operations, generally incorporate governors designed to maintain a predetermined operative speed. An example of such a governor can be found in U.S. Pat. No. 3,552,410 issued Jan. 5, 1971, to Lester A. Amtsberg.

To avoid dangerous overspeeds, which could happen if the governor failed to properly function, an overspeed control means is often utilized to tools of the type under consideration. Examples of such overspeed safety devices can be found in U.S. Pat. No. 3,923,429 issued Dec. 2, 1975 to Raymond J. Schaedler and Robert D. Roth, as well as U.S. Pat. No. 3,749,530 issued July 31, 1973 to German Amador.

The overspeed control means of the subject invention represents an improvement over such devices of the prior art primarily because of its extreme simplicity of structure providing low manufacturing costs and easy maintenance, while affording reliable, durable service.

DETAILED DESCRIPTION OF THE INVENTION

Figure 1:
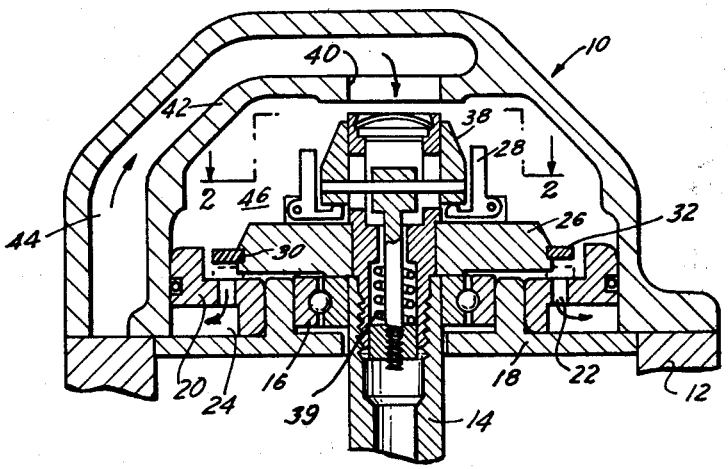
FIG. 1 is a vertical sectional view illustrating a housing portion of an air operated hand-held vertical grinder, which portion encloses a governor and an overspeed means, the latter embodying the principles of the invention.

Numeral 10 identifies a governor housing which is mounted to a cylinder housing 12, a portion of the latter being shown. The cylinder housing encloses a vane type rotor (not shown) and passageways are arranged to conduit pressurized air into the cylinder housing for rotation of the rotor, in a manner well known in the art, such as is in U.S. Pat. No. 3,749,530. A rotor shaft 14, extends into the governor housing 10, and is rotatably supported in a roller bearing 16 mounted in a circular end plate 18 enclosing the open end of the cylinder housing. A valve seat 20, supported in the plate 18, has a plurality of holes 22, which provide air egress from the top side of the valve seat, to an annular chamber 24 on the bottom side of the valve seat. The annular chamber 24 opens into passageways leading to the cylinder housing, whereby pressurized air is fed thereinto for rotation of the tool rotor.

Affixed to the end of the rotor shaft 14 is a governor cage 26 which has a pair of fly weights 28 pivotally mounted thereupon. A circumferential holding groove 30, extending about the periphery of the governor cage, is adapted to slidingly receive a spring plate valve 32.

Figure 2:
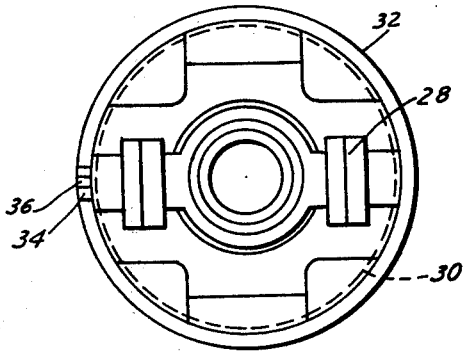
FIG. 2 is a view as seen from line 2—2 in FIG. 1.

As best seen in FIG. 2, the plate valve 32 has a gap or split region 34, which affords clearance to a pin 36 arranged in the groove 30 and projecting radially therefrom. The pin 36 serves to drive the plate valve 32, after the latter has been expanded by centrifugal force, to assure that the plate valve will be sufficiently expanded, by increasing centrifugal force, to become disengaged from the holding groove 30. The plate valve 32 is prestressed to remain in the groove 30, until expanded by centrifugal force caused by rotation of the governor cage 26, to the point where it will clear the lower outer edge of the groove. Subsequently, pressure differential between the upper surface and lower surface of the plate valve, caused by air flow into the holes 22, will move the valve into engagement with the valve seat 20, blocking off flow of air through the holes 22 and terminating rotor operation. The hole blocking condition of the valve is shown in dotted lines in FIG. 1. It will be noted that the thickness of the valve 32 is greater than the space beneath the governor cage 26 and the valve seat 20 so that the valve cannot slip therebetween.

A governor sleeve 38 is slidably arranged upon the end of the rotor shaft 14, and is movable upwardly by the fly weights 28 toward an air entrance opening 40 provided in a wall portion 42 of the governor housing 10. A biasing spring 39 is arranged to exert pressure upon the governor sleeve 38 so that the latter is biased toward open position. Such functional governor sleeve biasing arrangement is well known in the art, and is disclosed, for example, in U.S. Pat. No. 3,923,429. The opening 40 allows flow of air from a housing passageway 44 into a chamber 46 of the governor housing 10. The governor sleeve 38 will regulate air flow to the tool rotor in accordance with predetermined operational requirements, all is well known in the art.

The spring plate valve 32 is designed with a specific prestressed condition for response to a given rotational speed at which it will expand sufficiently to be released from its holding groove 30, and move to block the air holes 22. When a change in operating speed response is desired in any given tool, a replacement spring valve may be used to provide the new overspeed control value desired. Obviously, the overspeed control means can effectively function in either rotational direction of the tool motor.

It will be seen that once the spring valve is moved into hole blocking position to terminate tool operation, it will be necessary to remove the governor housing for replacement of the spring valve into the groove. At such time, an investigation can be made to determine what caused operation of the overspeed control means, and necessary steps taken to correct the condition that resulted in tool overspeed.

It will be seen that the subject invention is characterized by extreme simplicity in design and operational function, and provides a reliable and durable overspeed control means for use on tools of the type under consideration.

What is claimed is:

1. An overspeed control means for a pneumatic tool including a valve seat arranged to separate chambers of the tool exposed to pneumatic medium used for motivation of the tool, said valve seat being formed with a plurality of openings allowing flow of pneumatic medium from one chamber to the other chamber, a cage member affixed to a rotor shaft of the tool for rotation therewith, and a plate valve carried by the cage member, said plate valve being arranged to be released from the cage member upon development of a predetermined rotor shaft rotational speed, said plate valve upon release from the cage member being movable to cover said openings to restrict flow of pneumatic medium between the chambers causing termination of shaft rotation, said plate valve being in the form of a flat ring which has a gap allowing radial expansion of the valve.

2. An overspeed control means according to claim 1, wherein a circumferential groove is formed in the cage member to receive the plate valve and retain it therein until a predetermined centrifugal force expands the valve diametrically so that it can move out of the groove.

3. An overspeed control means according to claim 2, wherein the plate valve will remain in seated engagement with the valve seat to maintain hole blockage until the plate valve is manually removed therefrom.

4. An overspeed control means according to claim 3, wherein a speed regulating governor is arranged to regulate the rotational speed of the tool in accordance with operational requirements.

5. An overspeed control means according to claim 4, wherein the speed regulating governor includes fly weights pivotally affixed to the cage member and arranged to move a governor sleeve to regulate flow of air into one of the governor chambers.

6. An overspeed control means according to claim 5, wherein a pin is radially positioned in the circumferential groove, which pin is arranged to extend into the gap formed in the flat ring.

* * * * *